US006767147B2

(12) United States Patent
Jakubowski et al.

(10) Patent No.: US 6,767,147 B2
(45) Date of Patent: Jul. 27, 2004

(54) CODED RIBBON CARTRIDGE, DECODER, AND RIBBON INK CAPACITY INDICATOR WITH LCD DISPLAY

(75) Inventors: Peter Jakubowski, Huntington Beach, CA (US); Frank Benna, Roseland, NJ (US)

(73) Assignee: Amano Cincinnati, Inc., Roseland, NJ (US)

( * ) Notice: Subject to any disclaimer, the term of this patent is extended or adjusted under 35 U.S.C. 154(b) by 93 days.

(21) Appl. No.: 10/171,721

(22) Filed: Jun. 14, 2002

(65) Prior Publication Data

US 2003/0231915 A1 Dec. 18, 2003

(51) Int. Cl.[7] ..... B41J 33/32
(52) U.S. Cl. ..... 400/249; 400/207
(58) Field of Search ..... 400/249, 207; 338/162; 347/86, 19

(56) References Cited

U.S. PATENT DOCUMENTS

| | | | | |
|---|---|---|---|---|
| 4,797,016 A | | 1/1989 | Lahr | |
| 5,051,719 A | * | 9/1991 | Gaston et al. | 338/162 |
| 5,289,242 A | | 2/1994 | Christensen et al. | |
| 5,385,416 A | | 1/1995 | Maekawa et al. | |
| 5,385,625 A | | 1/1995 | LaFreniere | |
| 5,506,611 A | * | 4/1996 | Ujita et al. | 347/86 |
| 5,699,091 A | * | 12/1997 | Bullock et al. | 347/19 |
| 5,755,579 A | | 5/1998 | Yanase et al. | |
| 5,757,394 A | | 5/1998 | Gibson et al. | |
| 5,812,156 A | * | 9/1998 | Bullock et al. | 347/19 |
| 5,835,817 A | | 11/1998 | Bullock et al. | |
| 5,970,273 A | | 10/1999 | Zenk et al. | |
| 6,009,285 A | | 12/1999 | Barry et al. | |
| 6,019,449 A | * | 2/2000 | Bullock et al. | 347/14 |
| 6,025,993 A | | 2/2000 | Wakabayashi et al. | |
| 6,056,824 A | | 5/2000 | Bartholomew et al. | |
| 6,106,166 A | | 8/2000 | Spurr et al. | |
| 6,113,208 A | * | 9/2000 | Benjamin et al. | 347/7 |
| 6,126,265 A | * | 10/2000 | Childers et al. | 347/23 |
| 6,128,448 A | | 10/2000 | Arcaro et al. | |
| 6,152,625 A | | 11/2000 | Oliverio | |
| 6,155,664 A | | 12/2000 | Cook | |
| 6,161,915 A | | 12/2000 | Bolash et al. | |
| 6,169,860 B1 | | 1/2001 | Curry et al. | |

OTHER PUBLICATIONS

IBM Technical Disclosure Bulletin, NB 84124203, vol. 27, Issue No. 7B, p. 4203, Dec. 1984.*

* cited by examiner

*Primary Examiner*—Charles H. Nolan, Jr.
(74) *Attorney, Agent, or Firm*—Stetina Brunda Garred & Brucker

(57) ABSTRACT

A method and apparatus are provided for adaptively controlling printer functions of a dot matrix printer in response to sensing the type of printer ink cartridge being used. An identifying resistive value is applied to surface of the cartridge and installed within the printer. The printer includes contacts that include sensors and sensor circuitry useful to detect a presence of the resistive indicator and the resistive value thereof. The sensed resistive value is used to directly control printer functions, and/or to access stored data or printer control routines specific to the type of cartridge, or desired performance characteristics. Stored information, which may be appended by other sensed information such as printer usage data, is used to selectively regulate printer operation to achieve maximum efficiency and performance from the particular ink cartridge.

33 Claims, 7 Drawing Sheets

CODED RIBBON CARTRIDGE, DECODER, AND RIBBON INK CAPACITY INDICATOR WITH LCD DISPLAY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

Dot matrix printer assemblies utilize ribbon cartridges that contain continuous strip of material impregnated with an ink solution. The ribbon is contained in a cartridge container that normally mounts around the dot matrix printer's print head. As the ribbon passes between the printer head and a sheet of paper, information is then printer on to the sheet of paper.

In order to print the information, small rods or pins in the printer head are thrust into the ribbon, which then makes contact with the paper adjacent to the pins, thereby transferring ink from the ribbon to the paper. Through the proper combination of dots, the ink transferred is transformed into recognizable letters or symbols. The higher the impact force of the pins on the ribbon the darker the resulting image. Contemporary printers commonly produce a consistent impact force.

As the printer assembly moves across the sheet of paper, the ribbon formed as a continuous band, is also pulled laterally across the gap between the paper and the print head, continuously providing a new area to be struck by the pins in order to provide ink for the printing operation. If the ribbon did not continuously move, it would quickly wear out in response to repetitive striking of the same area.

At present, many pictures such as dot matrix printers, do not track ink usage. The user typically notices print cartridge deficiency only when the printer starts printing characters that are difficult to read. As a matter of practicality, it will often be the case that a replacement is not readily available. For a business, this often means extra cost incurred in the form of expedited shipping charges.

A second factor in obtaining optimum print quality and usage efficiency from an ink ribbon cartridge is the variations in print quality attributable to differences in the manufacture and type of ribbon. Competitive pressures cause some suppliers to use lower quality ribbon or inks, which may produce lighter images. In such cases the user may assume the problem is with the printer and not the ribbon.

Previous methods for determining the type of cartridges have included physical extrusions or indentations on the cartridge so that the printing unit can determine which cartridge model is being utilized. This has a limitation in that all of the possible permutations much be considered at the start of the program, in order to modify the tooling for the cartridge body and the sensors in the printing unit.

By contrast to prior art dot matrix printers, prior art laser printers have employed advanced systems for identifying cartridge mode. One such system is disclosed by U.S. Pat. No. 5,289,242 entitled "METHOD AND SYSTEM FOR IDENTIFYING THE TYPE OF TONER PRINT CARTRIDGES LOADED INTO ELECTROPHOTOGRAPHIC PRINTERS" issued to Christensen, et al. A metal label is installed on the print cartridge, and contacts in the laser printer are used to detect and connect the metal label to a DC voltage signal line. If there is no conductive metal strip, then the detected voltage level is at logic 1, or 5 volts. If there is a conductive metal strip, then detected voltage is at logic 0, or 0 volts. By passing current through the label and determining the results, the printer ascertains what type of cartridge is installed.

This system has the disadvantage that may not distinguish many types of cartridges. Moreover, if the label is dirty or improperly positioned, failure to detect cartridge type will result in assumption by the printer that no cartridge is installed, and thus the printer will not work. Furthermore, this system is inappropriate for dot matrix printers. The primary advantage of dot matrix printers over, for instance, laser printers is that both the printer and the ink cartridges are relatively inexpensive. The metal label component could be prohibitively expensive if applied to a dot matrix print cartridge.

A method and apparatus are provided for adaptively controlling printer functions of a dot matrix printer in response to sensing the type of printer ink cartridge being used. An identifying resistive value is applied to surface of the cartridge and installed within the printer. The printer includes contacts that include sensors and sensor circuitry useful to detect a presence of the resistive indicator, and the resistive value thereof. The sensed resistive value is used to directly control printer functions, and/or to access stored data or printer control routines specific to the type of cartridge, or desired performance characteristics. Stored information, which may be appended by other sensed information such as printer usage data, is used to selectively regulate printer operation to achieve maximum efficiency and performance from the particular ink cartridge.

The resistive indicator may be applied directly to a surface of the cartridge, or to a label that may be adhesively applied to the cartridge, to facilitate compatibility with different cartridges. In some cases a cartridge may support different labels, each conforming a to a different operational status of the printer.

By means of the present invention, information respecting one or more characteristics of the ink cartridges can be adaptively factored into printer operation in order to enhance image quality and to enhance the operational life of the ink cartridge.

A display will and/or alarm may be incorporated into the invention to provide a visual indication of the printer/ink cartridge status, remaining life or ink cartridge, and other data.

The resistive ink identifier may be formed in different ways, to provide different resistive values corresponding to operational parameters. In one embodiment the resistive ink identifier has a resistance value that is a function of its length. In other embodiments the resistive value of the ink identifier is a function of its width, or ink characteristics.

In the presently preferred embodiment print head impact force may be regulated, in response to sensed resistive values by varying the pulse width of the print head activation coil. As would be apparent to those with ordinary skill in the yard, various other methods may be used to regulate functions such as printer impact force, without departing from the broader aspects of the invention, as set forth below.

BRIEF DESCRIPTION OF THE DRAWINGS

These as well as other features of the present invention will become more apparent upon reference to the drawings wherein.

DETAILED DESCRIPTION OF THE INVENTION

Figure 1:
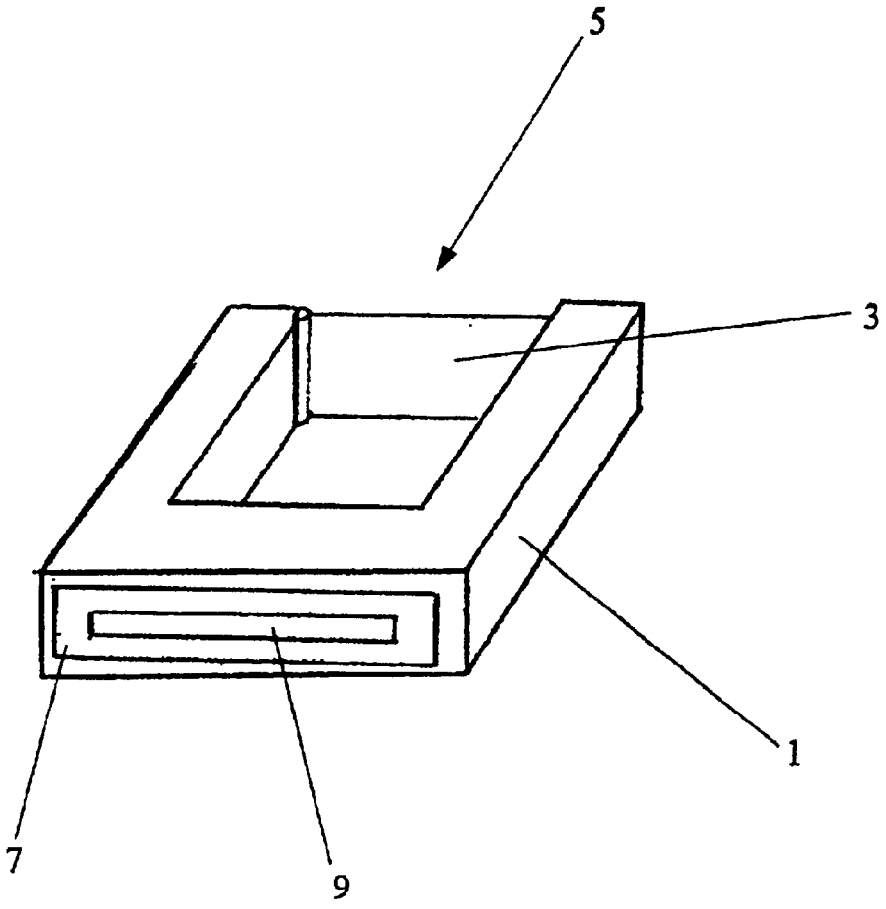
FIG. 1 is a view of a print cartridge designed in accordance with the present invention.

In accordance with the present invention there is provided a device and method for sensing the presence and type of cartridge installed in a dot matrix printer and for modifying printer functionality in response to the sensed information.

In order to distinguish between different ink ribbon cartridge models, it is cost efficient to use only one sensor or one sensor set, and still permit the usage of many different ribbon ink cartridge models. An electronic component, mounted upon the cartridge exterior services to identify and distinguish the cartridge model but manufacturing cartridges including such a component would be expensive. Besides the cost of the component itself, contact areas would also have to be installed. However, if the component were in the presently preferred embodiment, the electronic component or indicia is implemented as a resistor, silk-screened directly on the cartridge exterior or onto a printed resistor label the resistance value is used to signify, for example, the cartridge model and ribbon characteristics, such as ribbon type, length, ink density, etc. Where no resistor is sensed, for instance because an unclassified cartridge was installed, the cartridge would still function using default values not optimized values for printing. The silk-screened resistor could be silk-screened directly onto the cartridge at any convenient location. It could also be silk-screened onto a label that would be placed on the cartridge prior to shipment. The ability to add the resistor at any time would permit any cartridge presently in use to be classified and employed in connection with the present invention.

In the presently preferred embodiment of the present invention, the printer sensor is implemented by a simple pair of contacts which, when touching he silk-screened resistor, can be used to determine the resistance value of the resistor. The value of the silk-screened resistor is compared to a value stored in memory of the printing unit. The stored values are defined for known models and can also define extrapolated future models. The resistance value could be used to regulate printer striking force, specify the number of characters that can be printed from the ribbon (length/type of ribbon), the amount of ink density or remaining ink on the ribbon, etc. Different resistive values may be applied by varying the material used to fabricate the resistor, i.e. the use of different conductivity/resistivity materials. Alternatively, resistor paths lengths can be varied to produce different resistances while using the same conductivity materials. In another implementation different resistor values are obtained by varying the length to width ratio of the resistor materials, as such, one of ordinary skill will recognize that technique for applying resistive indicators of various resistor values, may vary, dependant upon cost, ease of application, etc. A color-coding scheme would also be provided, so that the customer could more easily distinguished between and select different capacities for the tape ribbon cartridge by the resistor color.

Printer control circuitry can be used and optimized to vary the applied printing force for improved quality of readability. Printing force can be varied in response to contact factors, such as ribbon type, ribbon length and ink density. Printing force can also be varied in response to additional sensed parameters, such as ongoing ribbon usage (ribbon advance).

Printer control circuitry can also implement stored programs to selectively implement other functions, as most efficient for the sensed cartridge. For example, by knowing the type and capacity of the ribbon, and number of characters already punched, the remaining capacity of the particular cartridge can be known. As the ribbon is reaching the end of its ink supply, the time between pin strikes could also be lengthened to make the printed characters remain dark for longer, thereby increasing the life of the ink ribbon cartridge.

A LCD display can be used to display the remaining life of the ink ribbon cartridge and provide a visual and/or audio indication when the ink life is below a certain level. The level can be either stored or generated as the cartridge ink is being used, thereby providing an advance warning to the operator. As the ribbon cartridge is changed, the counter can be automatically zeroed.

Referring now to the drawings, FIG. 1 is a view of an exemplary ink cartridge designed in accordance with the present invention. Housing 1 contains the unexposed portion of the ribbon 3 as well as mechanisms (not shown) for cycling the ribbon through the exposure area 5. A label 7 if affixed to the housing 1. The label includes a resistive ink identifier 9. Alternatively, the resistive ink identifier 9 could be affixed directly to the housing 1. In a preferred embodiment of the invention, the resistive ink identifier is a silk screened conductive ink. The silk-screened conductive ink has the advantage of being cheap and easy to apply.

Figure 2A:
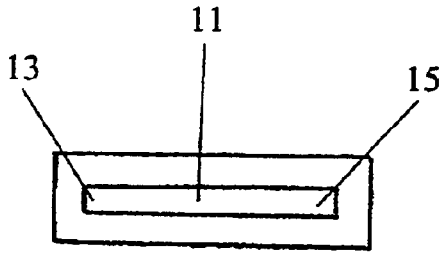
FIG. 2*a* is a view of a label with a resistive ink identifier.
Figure 2B:
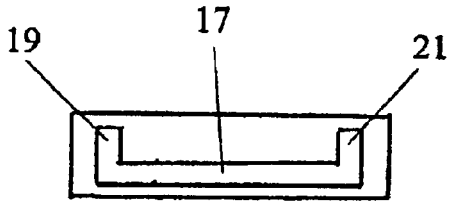
FIG. 2*b* is a view of a label with an alternate resistive ink identifier.

FIGS. 2*a* and 2*b* illustrate how the resistive value of the resistive ink identifier can be varied by altering the length of the resistive ink identifier. In FIG. 2*a*, the resistive ink identifier 11 follows the shortest possible path between the two contact points 13 and 15. This resistive ink identifier 11 will therefore have a relatively low resistive value. In FIG. 2*b*, the resistive ink identifier 17 follows a relatively longer path between the two contact points 19 and 21. This resistive ink identifier 17 will therefore have a higher resistive value than the resistive ink identifier 11 of FIG. 2*a*.

Resistance may be measured in ohms/square, and resistances range from less than one ohm/square to thousands of ohms/square. The resistance of an inked path is the product of the squares and the ohms/square. For example, a path of length L may be a total resistance of 1000 ohms. If the path were made twice as long or ½ as wide, the resistance would be 2000 ohms. The resistance would also become 2000 ohms if the ohms/square of the resistive material was doubled. By assigning ink cartridge characteristics to different resistive values, the resistive value of the resistive identifier can be used to represent those characteristics. For instance, the resistive value of the restive ink identifier may be used to access information representative of various physical characteristics of the ink ribbon in the ink cartridge such as the length of the ribbon, the ink density of ink, the ribbon or optimum impact force. Alternatively, a ratio could be assigned between resistive value and total ink capacity. In the latter case, the resistive value would correspond directly to the ink capacity of die ink cartridge, the ink capacity could be measured by various means, but would probably be measured by an estimated number of characters that can be printed. As an additional feature, the resistive ink components may be color coded for convenient identification by a human user.

Figure 3:
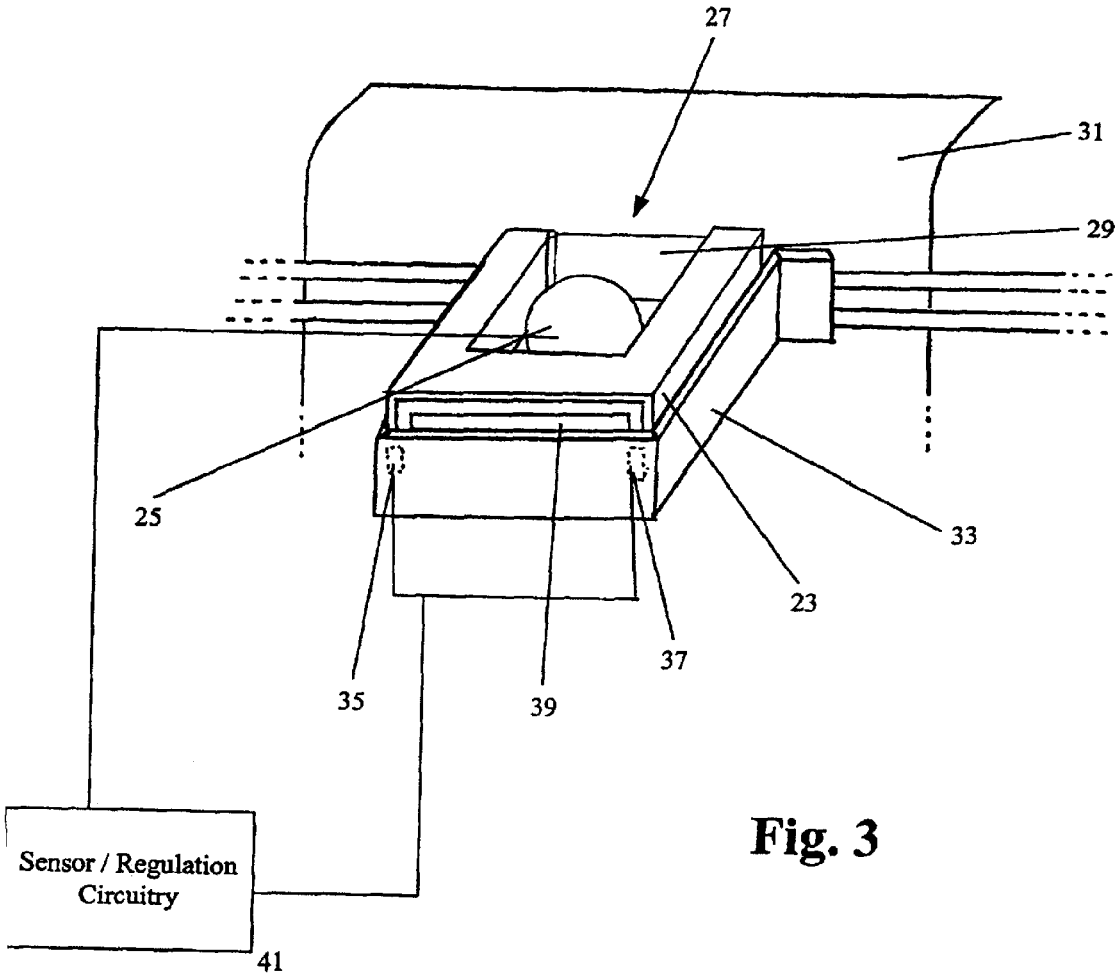
FIG. 3 is a view of a print cartridge designed in accordance with the present invention.

FIG. 3 illustrates an exemplary ink cartridge 23; designed in accordance with the present invention, installed into a dot matrix printer. In this view, it can be seen how the printer head 25 is interposed between the exposed area 27 of the ink ribbon 29 and the document 31 to be printed on, when the ink cartridge 23 is properly installed into the cartridge holder 33. In order to print, pins on the printer head 25 are thrust toward the document 31. Because the ink ribbon 29 is interposed between the printer head 25 and the document 31, ink from the ink ribbon 29 is transferred to the document 31 as the pins urge the ribbon against the document. As the printer prints, the ink ribbon 29 is advanced across the exposed area 27 by a mechanism (not shown) in the print cartridge 33.

When the ink cartridge 23 is installed into the cartridge holder 33, contact points on the resistive ink identifier 39 are in electrical communication with contact 35 and 37 disposed on the cartridge holder 33. The contracts 35 and 37 are in electrical communication with sensor/regulation circuitry 41. The circuitry 41 is in electrical communication with print head activation circuitry 42, which regulates movement of the printer head 25 or other functional components of the printer.

Figure 4A:
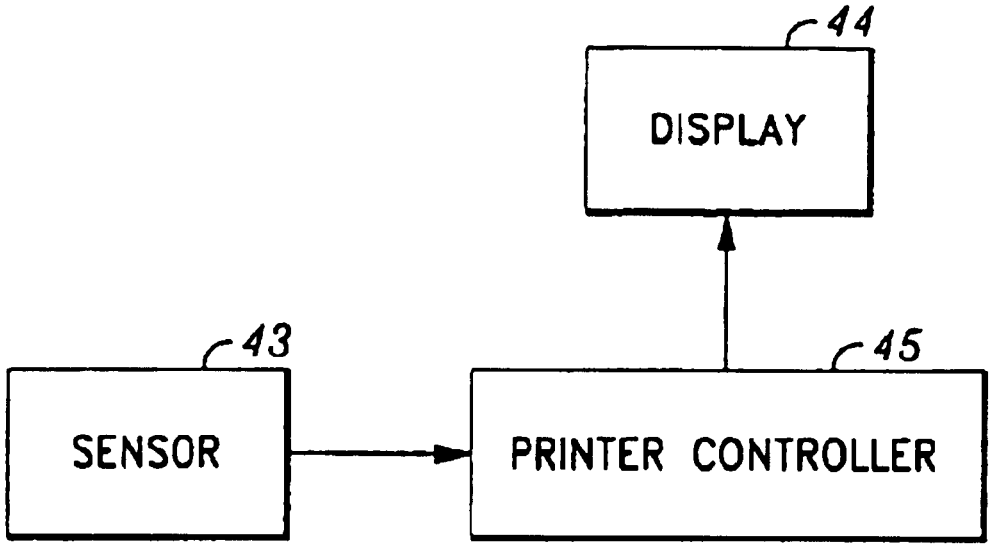
FIG. 4*a* is a diagram of a basic implementation of sensor/regulation circuitry in a printer designed in accordance with the present invention.

FIG. 4*a* illustrates a basic hardware embodiment of the sensor/regulation circuitry 41 of FIG. 3. As shown, therein, a sensor 43 is operative to sense the resistive value of the resistive ink identifier. Printer controller 45 is in electrical communication with the sensor 43 and is operative to regulate printing functions, e.g. impact force, in response to the sensed resistive value. The printer controller 45 may comprise a simple comparator circuit (not shown) used to translate the sensed resistive value into printer control data, if necessary. Display 44 is an electrical communication with the printer controller and operative to display information representative of usage data and the amount of ink left in the ink cartridge.

Figure 4B:
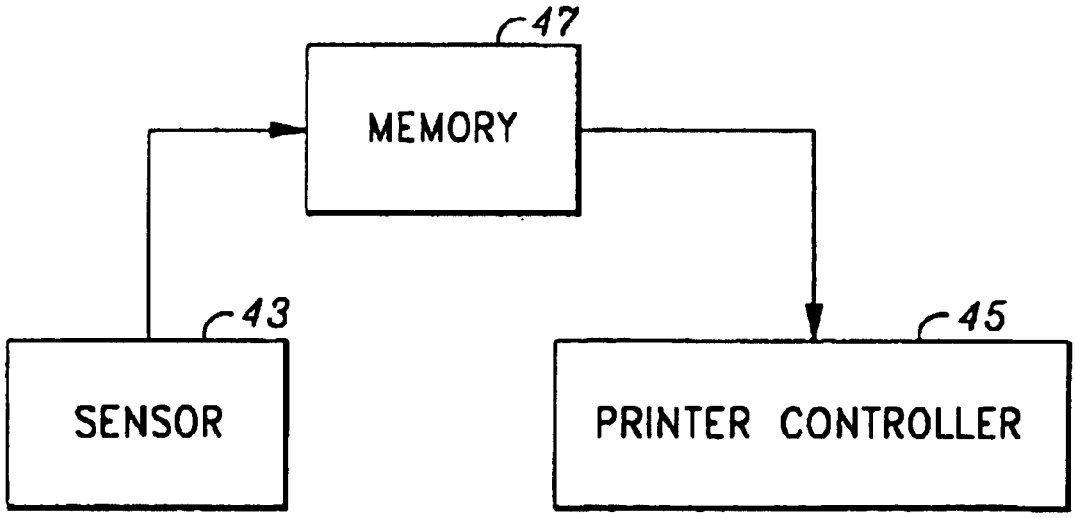
FIG. 4*b* is a diagram of a more advanced implementation of sensor/regulation circuitry in a printer designed in accordance with present invention.

FIG. 4*b* illustrates a software embodiment utilizing memory 47 in electrical communication with the sensor 43 and printer controller 45. In this embodiment, the memory is operative to store printer control data correlated to the identified type of cartridge, such as information on the length of the ink ribbon in the ink cartridge, and/or information on the density of ink on that ink ribbon. The memory can also store operational routines for directing printer functions in response to the specific data attributable to the identified cartridge.

When the sensor 43 senses the resistive value of the resistive ink identifier, the memory responds to the sensed resistive value by correlating the sensed resistive value with printer control data in memory. The printer control data thus correlated and/or the corresponding operational routines are sent to the printer controller 45, which regulates printing in response to that input.

FIG. 4 illustrates the mechanical method by which printing may be regulated in accordance with a preferred embodiment of the present invention. As striker 49 is operative to cause pins in the printer head to strike the document to be printed on (see FIG. 3) The striker may be connected to the pins of the printer head (see FIG. 3) in a variety of fashions as known in the art. The striker comprises a coil 51 disposed about a pin or ram 53. Energizing the coil 51 causes the ram 53 to travel in a direction 55 to a strike point 57. The strike point 57 is the point at which the pin in the printer head strikes the document to be printed (see FIG. 3).

Figure 5:
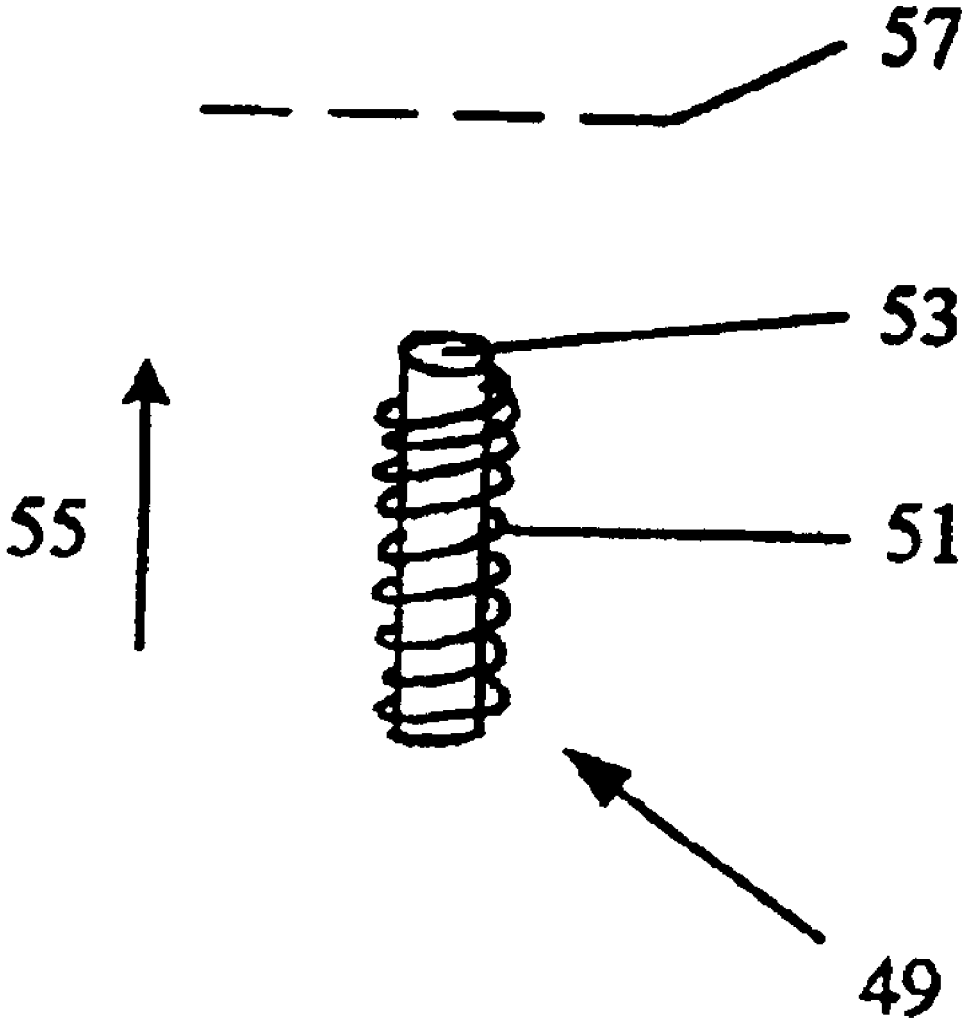
FIG. 5 is a view of a striker of a dot matrix printer.
Figure 6:
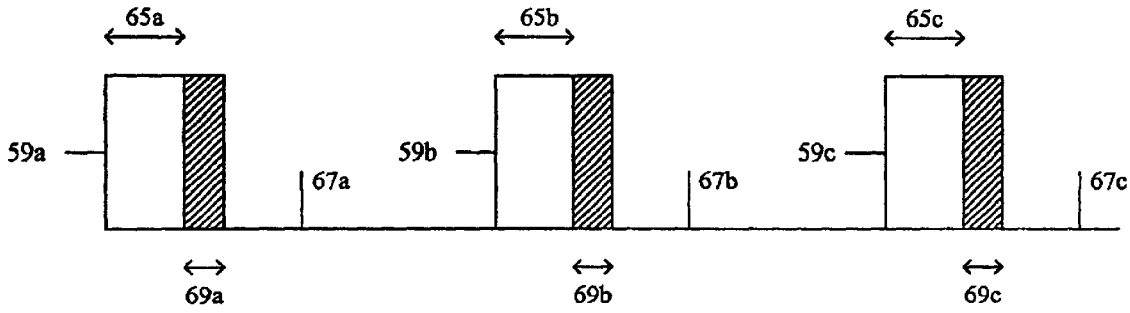
FIG. 6 is a graph showing how the strike force of the striker can be modified by changing pulse width.

Referring now to FIG. 6, it can be seen how the process of regulating impact force may be accomplished by means of a series of energizations of the coil, or pulses 59*a,b,c*. Each pulse 59*a,b,c* has a default pulse width 65*a,b,c*, which represent the mount of time for which the coil is energized. Points 67*a,b,c* which represents the amount of time for which the coil is energized. Points 67*a,b,c* which represents the amount of time for which the coil is energized. Points 67*a,b,c* represent points in time at which the ram reaches the strike point (see FIG. 50). it can be seen from the drawing that the pulse width 65*a,b,c* do not extend for the entire time between the points in time 67*a,b,c*. In other words, the ram is not normally accelerated during the entire length of its travel to the strike point (see FIG. 5) Modification of the impact force of the print head, may therefore be, be accomplished by changing the pulse widths 65*a,b,c*, of the pulses 59*a,b,c*. For instance, a pulse width addition 69*a,b,c* may be added to each pulse width 65*a,b,c*. For instance, a pulse width addition 69*a,b,c*, may be added to each pulse width 65*a,b,c*. Referring again to FIG. 5, in so doing will result in the ram 53 being accelerated for a greater portion of the time spent traveling in the direction 55 to the strike point 57. The ram 53 will thereby achieve a higher force by the time it reaches the strike point 57, and the connected pin of the printer head will therefore strike the document to be printed on with more force (see FIG. 3). Accordingly, a relatively higher amount of ink will be transferred from the ink ribbon to the document to be printed on.

Correspondingly, reducing the pulse width will reduce the impact force, and lighten the resulting image. As those skilled in the art will recognize, the broader teachings of the present invention may be utilized not only to identify and implement appropriate printer control functions for an identified printer cartridge. The invention also has application where a user may wish to purposely depart from normally nominal printer control functions for a particular purpose. For example, with a mechanical operation of the printer impaired, the user may prefer to implement a higher impact force than would normally be nominal. This can be done by a variety of processes, including removing the resistive label and replacing it with a different label so that results in the application of a higher impact force. As such, the resistive label may serve as a physical variant to control and to implement different control functions in accordance with predefined operational profiles.

Figure 7:
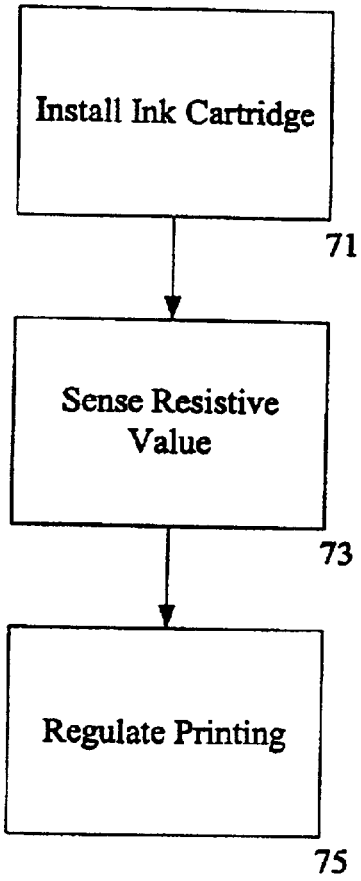
FIG. 7 is a block diagram illustrating the method of using the sensor/regulation circuitry of FIG. 4*a;*

FIG. 7 illustrates the method of use of the basic circuitry illustrated in FIG. 4*a*. First, an ink cartridge is installed into the printer (step 71). When the ink cartridge is so installed, the resistive value of its resistive ink identifier is sensed (step 73). The printer controller responds to the sensed resistive value by regulating printing (step 75). In this embodiment, the resistive value of the resistive ink identifier could be used, for instance, to represent a relative density of the ink on the ink ribbon of the ink cartridge. If the density was relatively high, the printer controller could respond to the sensed resistive value by causing the pins of the print head to strike with less force, i.e. a shorter pulse width. Conversely, if the density was relatively low, the printer controller would respond to the sensed resistive value by causing the pins of the print head to strike with more force. Accordingly, a uniform darkness of printed characters would be achieved by the system no matter what type of print cartridge was installed.

Figure 8:
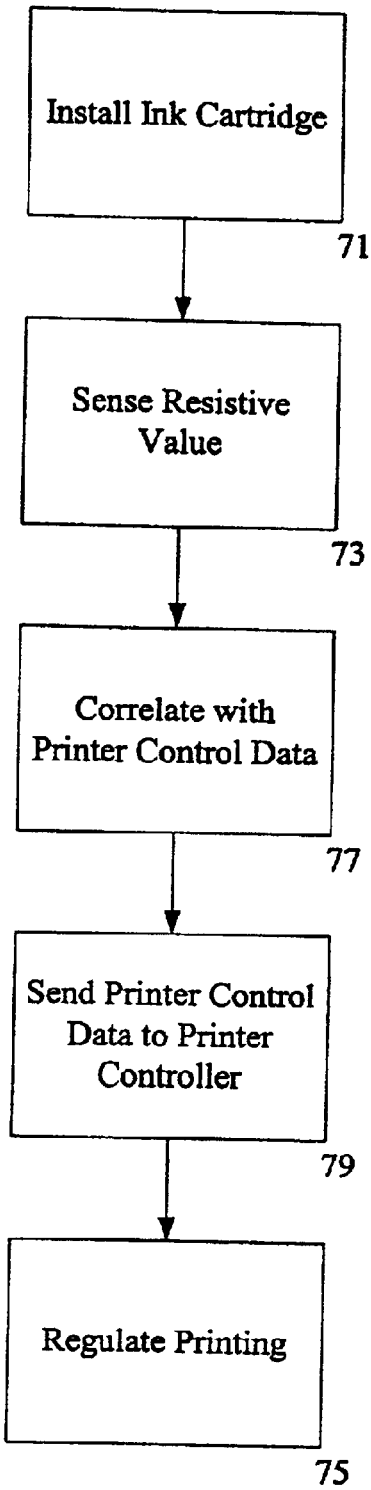
FIG. 8 is a block diagram illustrating a basic method of using the sensor/regulation circuitry of FIG. 4*b.*

FIG. 8 illustrates a basic method of use for the circuitry illustrated in FIG. 4*b*. As in the previous method, an ink cartridge is installed (step 71) and the resistive value of the resistive ink identifier on the ink cartridge is sensed (step 73). However, in this method a memory is used to correlate the sensed resistive value with printer control data in the memory (step 77). The correlated printer control data and/or operational routines are input to the printer controller (step 79) which then regulates printing in response to the received input (step 75). In this embodiment, the resistive value of the resistive ink identifier maybe be used to represent, for instance, a make or model of the print cartridge. The memory would then include information on an a variety of characteristics of such make and model, for instance the length of the ribbon or the density of ink on the ribbon, stored as printer control data. The printer controller would respond to this printer control data and/or corresponding operational routines by regulating printing accordingly. The strike force of the pins on the pin head could be increased or decreased, the rate at which the ribbon was cycled through the ink cartridge could be increased, or a number of other functions my be affected.

Figure 9:
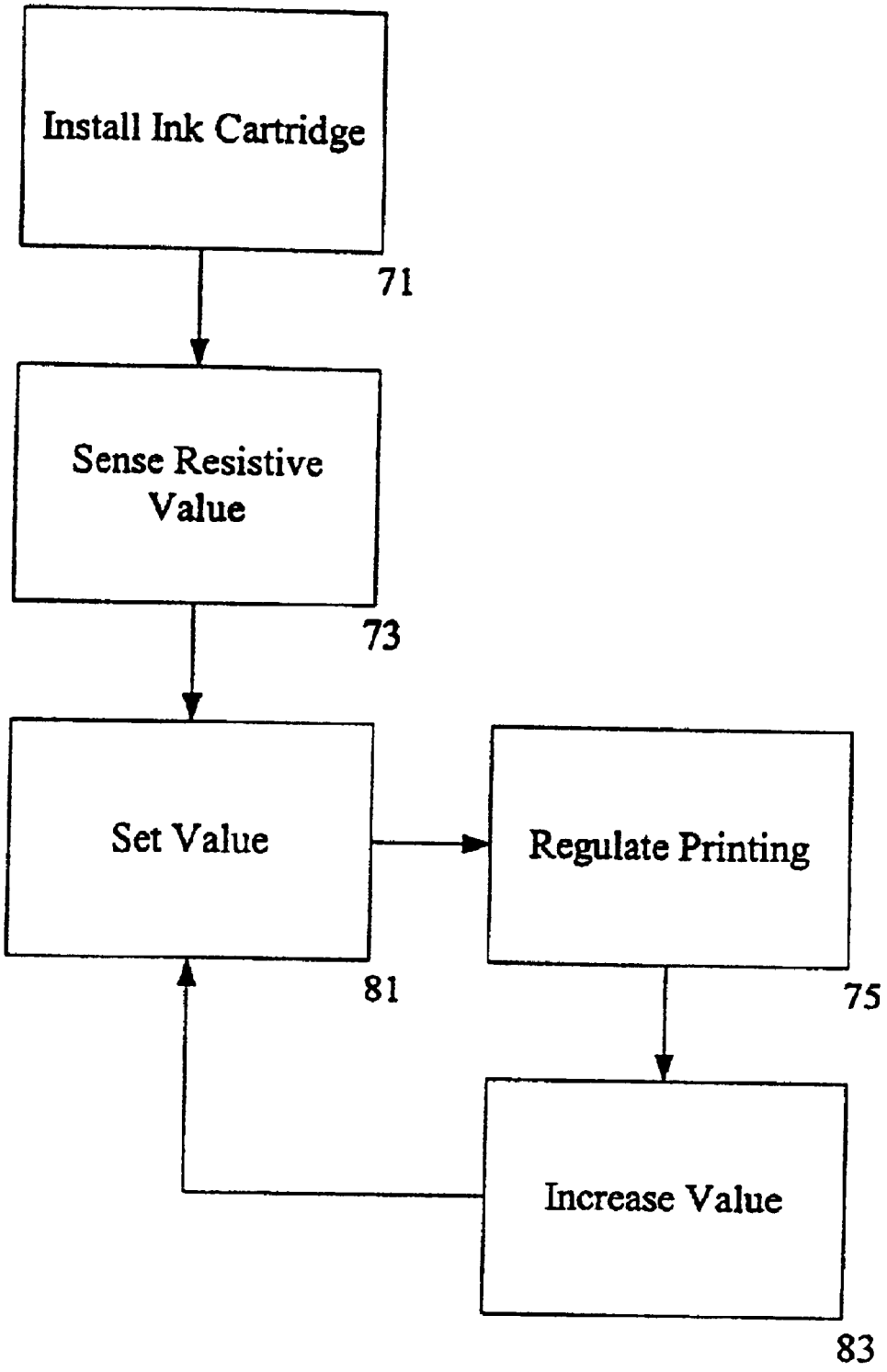
FIG. 9 is a block diagram of an advanced method of using the sensor/regulation circuitry of FIG. 4*b.*

FIG. 9 illustrates a method of implementing the invention in relation to the circuitry illustrated in FIG. 4*b* First, the ink cartridge is installed into the printer (step 71). If no value is sensed, the printer operates in accordance with default parameters where a resistive value of the resistive ink identifier is sensed (step 73), the sensed resistive value is correlated to information set in memory (step 81). The information, which may include data and/or operational routines, is used to define and implement a pulse width to be employed when energizing the coils of the striker (see FIG. 5) In response to this information, the printer controller regulates printing (step 75). As printing continues, the value is increased (step 83). A counter increments the number of key strokes and that data is used, e.g. combined with the operational routines, to redefine, e.g. increase the pulse width, or to increase impact force. The redefined pulse width and any other redefined parameters maybe stored in memory (step 81). The result is that 45 the printer prints more and more, the pulse/width impact force increases accordingly and the striker is thereby caused to strike with a gradually increasing amount of force.

As printing is done, the amount of ink available in an ink cartridge is gradually depleted. However, much ink is remaining in the ink cartridge, it is distributed, more or less evenly over the ink ribbon. Thus, if less ink is left then the relative density of ink on the ribbon is lower. As a result, in prior art printers, as the ink is depleted the characters printed on a document to be printed grow steadily less dark. Steadily increasing the force with which the striker strikes in accordance with this embodiment of the present invention counteracts with this trend and ensures that the characters printed by the printer continue to be satisfactorily dark.

The system may comprise additional elements intended to provide further functionality. For instance, an alarm maybe in electrical communication with the memory. The alarm is operative to generate an alarm when data stored in the memory indicates that a relatively low amount of ink is left in the ink cartridge. Likewise, the system could comprise a display operative to display the amount of ink left in the ink cartridge. Alternatively, the printer controller could be configured to automatically cease functioning when the amount of ink left in the ink cartridge reached a selected threshold level.

It is understood that although the above represents several embodiments of the invention, the invention may take a still wider variety of embodiments intended to effect alternate designs or additional features. For instance, the force with which the striker strikes could be modulated by means of varying pulse amplitude instead of pulse width. Such embodiments are within the scope and spirit of the present invention.

What is claimed is:

1. A method for selectively regulating printer operation of a printer, comprising:

a) applying a resistive ink identifier to an exterior surface of an ink cartridge, the resistive ink identifier having a resistive value corresponding to at least one operational characteristic of the ink cartridge;

b) installing the ink cartridge into a printer;

c) sensing the resistive value of the resistive ink identifier, where the resistive value corresponds to a physical characteristic of the ribbon; and d) selectively regulating printing functions in response to the sensed resistive value.

2. The method of claim 1, wherein the resistive value corresponds to a length of an ink ribbon of the ink cartridge.

3. The method of claim 1, wherein the resistive value corresponds to ribbon material used in the ink cartridge.

4. The method of claim 1, wherein the resistive value corresponds to a material of an ink ribbon of the ink cartridge.

5. The method of claim 1, wherein the resistive ink identifier is silk screened onto the exterior surface of the ink cartridge.

6. The method of claim 1, wherein the resistive ink indicator is applied to a label that is adherable to the ink cartridge.

7. The method of claim 1, wherein the resistive value of the resistive ink identifier is a function of the length of the identifier.

8. The method of claim 1, wherein the resistive value of the resistive ink identifier is a function of the width of the identifier.

9. The method of claim 1, wherein the resistive value of the resistive ink identifier is a function of material used to form the identifier.

10. The method of claim 1, wherein the step of correlating the sensed resistive value with the characteristics of the ink cartridge comprises:

a) communicating data responsive to the sensed resistive value to a memory; and b) accessing stored printer control information in the memory, the stored information corresponding to operational parameters specific to the type of cartridge being used; and c) regulating printer operation in response to the stored printer control information.

11. The method of claim 1, wherein the step of regulating printing functions comprises:

sensing printer usage data on an ongoing basis; and varying printer operation in response to the sensed printer usage data.

12. The method of claim 11, wherein the step of sensing printer usage data comprises sensing the number of characters which have been printed by the printer.

13. The method of claim 11, wherein the step of varying printer operation comprises the step of regulating print head impact force in response to sensed printer usage data.

14. A method for selectively regulating printer operation of a printer, comprising:

a) applying a resistive ink identifier to an exterior surface of an ink cartridge, the resistive ink identifier having a resistive value corresponding to at least one operational characteristic of the ink cartridge;

b) installing the ink cartridge into a printer;

c) sensing the resistive value of the resistive ink identifier, where the resistive value corresponds to a physical characteristic of the ribbon;

d) wherein the resistive value of the resistive ink identifier is a function of a physical characteristic of the identifier; and e) selectively regulating printing functions in response to the sensed value.

15. The method of claim 14, wherein the resistive value corresponds to a length of an ink ribbon of the ink cartridge.

16. The method of claim 14, wherein the resistive value corresponds to ribbon material used in the ink cartridge.

17. The method of claim 14, wherein the resistive value corresponds to a material of an ink ribbon of the ink cartridge.

18. The method of claim 14, wherein the resistive ink identifier is silk screened onto the exterior surface of the ink cartridge.

19. The method of claim 14, wherein the resistive ink indicator is applied to a label that is adherable to the ink cartridge.

20. The method of claim 14, wherein the resistive value of the resistive ink identifier is a function of the length of the identifier.

21. The method of claim 14, wherein the resistive value of the resistive ink identifier is a function of the width of the identifier.

22. The method of claim 14, wherein the resistive value of the resistive ink identifier is a function of material used to form the identifier.

23. The method of claim 14, wherein the step of correlating the sensed resistive value with the characteristics of the ink cartridge comprises:

a) communicating data responsive to the sensed resistive value to a memory; and b) accessing stored printer control information in the memory, the stored information corresponding to operational parameters specific to the type of cartridge being used; and c) regulating printer operation in response to the stored printer control information.

24. The method of claim 14, wherein the step of regulating printing functions comprises:

sensing printer usage data on an ongoing basis; and varying printer operation in response to the sensed printer usage data.

25. The method of claim 24, wherein the step of sensing printer usage data comprises sensing the number of characters which have been printed by the printer.

26. The method of claim 24, wherein the step of varying printer operation comprises the step of regulating print head impact force in response to sensed printer usage data.

27. A method for selectively regulating printer operation of a printer, comprising:

a) applying a resistive ink identifier to an exterior surface of an ink cartridge, the resistive ink identifier having a resistive value corresponding to at least one operational characteristic of the ink cartridge;

b) installing the ink cartridge into a printer;

c) sensing the resistive value of the resistive ink identifier, where the resistive value corresponds to a physical characteristic of the ribbon; and d) selectively regulating printing functions in response to the sensed resistive value;

e) wherein the step of regulating printer functions comprises the steps of sensing the number of characters which have been printed by the printer and varying printer operation in response to the sensed number of characters.

28. The method of claim 27, wherein the step of varying printer operation comprises the step of regulating print head impact force in response to sensed printer usage data.

29. A method for selectively regulating printer operation of a printer, comprising:

a) applying a resistive ink identifier to an exterior surface of an ink cartridge, the resistive ink identifier having a resistive value corresponding to at least one operational characteristic of the ink cartridge;

b) installing the ink cartridge into a printer;

c) sensing the resistive value of the resistive ink identifier, where the resistive value corresponds to a physical characteristic of the ribbon; and d) selectively regulating printing functions in response to the sensed resistive value;

e) wherein the step of regulating printer functions comprises sensing printer usage data on an ongoing basis and regulating print head impact force in response to sensed printer use to the sensed printer usage data.

30. The method of claim 29, wherein the step of sensing printer usage data comprises sensing the number of characters which have been printed by the printer.

31. The method as recited in claim 1, wherein the step of regulating printer functions comprises sensing printer usage data.

32. The method as recited in claim 31, further comprising the step of displaying information representative of printer usage data.

33. The method as recited in claim 32, further comprising the step of displaying information representative of the amount of ink remaining in the ink cartridge.

* * * * *